US009122245B2

(12) United States Patent
Stranczl et al.

(10) Patent No.: US 9,122,245 B2
(45) Date of Patent: Sep. 1, 2015

(54) TIMEPIECE MECHANISM CASSETTE

(71) Applicant: Nivarox-FAR S.A., Le Locle (CH)

(72) Inventors: Marc Stranczl, Nyon (CH); Thierry Hessler, St-Aubin (CH); Jean-Luc Helfer, Le Landeron (CH)

(73) Assignee: Nivarox-FAR S.A., Le Locle (CH)

( * ) Notice: Subject to any disclaimer, the term of this patent is extended or adjusted under 35 U.S.C. 154(b) by 0 days.

(21) Appl. No.: 14/218,052

(22) Filed: Mar. 18, 2014

(65) Prior Publication Data

US 2014/0286141 A1 Sep. 25, 2014

(30) Foreign Application Priority Data

Mar. 19, 2013 (EP) ..... 13160024

(51) Int. Cl.

| | |
|---|---|
| ***G04B 29/00*** | (2006.01) |
| ***G04B 15/00*** | (2006.01) |
| ***G04B 17/00*** | (2006.01) |
| ***G04B 17/04*** | (2006.01) |
| ***G04B 15/14*** | (2006.01) |
| ***G04B 29/02*** | (2006.01) |

(Continued)

(52) U.S. Cl.

CPC ..... *G04B 15/14* (2013.01); *G04B 15/00* (2013.01); *G04B 29/00* (2013.01); *G04B 29/02* (2013.01); *G04B 29/022* (2013.01); *G04B 29/04* (2013.01); *G04B 31/00* (2013.01)

(58) Field of Classification Search

CPC ..... G04B 29/02; G04B 29/022; G04B 29/04
USPC ..... 368/124, 125, 127–133, 168–178, 318
See application file for complete search history.

(56) References Cited

U.S. PATENT DOCUMENTS

| | | | | |
|---|---|---|---|---|
| 580,046 | A * | 4/1897 | Harrington | 368/318 |
| 2,604,754 | A * | 7/1952 | Favret | 368/175 |
| 2,968,186 | A * | 1/1961 | Jeanneret | 74/1.5 |

(Continued)

FOREIGN PATENT DOCUMENTS

| | | |
|---|---|---|
| CH | 338779 | 5/1959 |
| DE | 2 218 663 | 10/1973 |

(Continued)

OTHER PUBLICATIONS

European Search Report issued Dec. 10, 2013, in Patent Application No. EP 13 16 0024, filed Mar. 19, 2013 (with English-language translation).

*Primary Examiner* — Amy Cohen Johnson
*Assistant Examiner* — Daniel Wicklund
(74) *Attorney, Agent, or Firm* — Oblon, McClelland, Maier & Neustadt, L.L.P.

(57) ABSTRACT

A timepiece mechanism cassette including at least one bearing surface for positioning the cassette in a movement, a plate and a bar, at least one of which is rigid, and functional components arranged between or on the plate and the bar. At least two of the functional components are movable relative to each other. The plate and bar form an inseparable single piece component with at least one of the functional components and with at least one elastically deformable connecting element. The plate and bar are movable between a proximate position where they are separated by a minimum distance and a distal position where they are separated by a maximum distance. The plate and bar include a snap fit connection for holding them in the proximate position.

17 Claims, 9 Drawing Sheets

(51) Int. Cl.
*G04B 29/04* (2006.01)
*G04B 31/00* (2006.01)

(56) References Cited

U.S. PATENT DOCUMENTS

| | | | | |
|---|---|---|---|---|
| 3,186,160 | A * | 6/1965 | Dickerman | 368/174 |
| 3,582,162 | A | 6/1971 | Baermann | |
| 5,369,627 | A * | 11/1994 | Ikegami | 368/88 |
| 2007/0147180 | A1* | 6/2007 | Rufenacht et al. | 368/184 |
| 2010/0108697 | A1* | 5/2010 | Cadau et al. | 220/632 |
| 2012/0134242 | A1* | 5/2012 | Wyssbrod | 368/76 |
| 2013/0051190 | A1* | 2/2013 | Villar et al. | 368/132 |
| 2013/0070570 | A1* | 3/2013 | Colpo et al. | 368/127 |

FOREIGN PATENT DOCUMENTS

| | | | |
|---|---|---|---|
| EP | 2 605 079 | A1 | 6/2013 |
| EP | 2 605 087 | A1 | 6/2013 |
| FR | 1.047.190 | | 12/1953 |
| JP | 51-41667 | U | 3/1976 |
| JP | 51-49063 | U | 4/1976 |
| NL | 11224 | | 6/1919 |
| WO | 2011/120180 | A1 | 10/2011 |

* cited by examiner

TIMEPIECE MECHANISM CASSETTE

This application claims priority from European Patent application No. 13160024.9 filed Mar. 19, 2013, the entire disclosure of which is hereby incorporated by reference.

FIELD OF THE INVENTION

The invention concerns a timepiece mechanism cassette including at least one bearing surface for positioning said cassette in a movement and at least one bottom plate and one top bar, at least said plate or said bar being rigid, between or on which there are arranged functional components at least two of which are movable relative to each other, and between said plate and bar there is pivoted or moved at least one said pivotally or shiftably movable functional component, wherein said bottom plate and/or said top bar forms an inseparable single-piece component with at least one of said functional members, and form a single-piece assembly with at least one elastically deformable connecting element, and where said plate and bar are movable between a proximate position where they are separated by a minimum distance and a distal position where they are separated by a maximum distance.

The invention also concerns a mechanical timepiece movement including at least one cassette of this type.

The invention concerns the field of timepiece mechanisms, and more specifically movements integrating ready-to-use functional modules.

BACKGROUND OF THE INVENTION

The use of modular assemblies permits the manufacture of families of products using a common base, each personalised by different options or functions, notably complications in the case of a mechanical timepiece movement.

The concept of extremely high precision modules or cassettes allows large scale production to be combined with high quality goods.

Thus, modular sub-assemblies for timepiece movements are known, from EP Patent Application Nos 11193173.9 and 11193174.7 in the name of ETA SA.

The mechanical modules disclosed in these Patent Applications are irreversibly pre-adjusted and assembled to ensure the durability of their settings.

NL Patent No 11224C in the name of WATSON and WEBB describes an escapement mechanism housed inside a U-shaped oscillating pendulum block, between the leaves of which a support arbour for a straight balance is movable in a limited manner, in two lateral holes shaped in the arc of a circle, said arbour also pivoting and carrying the pallets, the escape wheel being pivoted in a cantilevered manner in a bore common to the oscillating block and to a fixed structure.

U.S. patent application Ser. No. 580046A in the name of HARRINGTON also describes a U-shaped structure, whose flanks carry mobile component bearings, in particular for the pallets or components of the escapement mechanism.

U.S. Pat. No. 3,582,162 A in the name of BAERMANN describes a magnetic bearing, of the electrical counter type, carrying a balance housed between two arms of a U-shaped armature.

However, in a conventional embodiment, the modules do not always allow for a reduction in the number of components, which would both reduce production costs and simplify the assembly plan, enabling mid-level technical personnel to assemble and adjust the most complex functions.

SUMMARY OF THE INVENTION

Thus, the invention proposes to provide modules, preferably in the form of cassettes, with a reduced number of components and having average assembly and adjustment complexity.

The present invention utilises, for this purpose, the new micro-component manufacturing technologies, MEMS, "LIGA", lithography and suchlike, to optimise the manufacture of the modules, shown here as cassettes. These cassettes may be irreversibly assembled to each other as in the above two Patent Applications, or positioned and assembled in a conventional manner.

The invention concerns, on one hand the composition of the cassettes, with a reduction in the number of components by the combined integration of several components in the form of a single-piece sub-assembly, and on the other hand, more specifically, the attainment of the largest possible number of functions in a single-piece on a plate or bar.

The invention therefore concerns a timepiece mechanism cassette including at least one bearing surface for positioning the cassette in a movement and at least one bottom plate and one top bar, at least said plate or said bar being rigid, between or on which there are arranged functional components at least two of which are movable relative to each other, and between said plate and bar there is pivoted or moved at least one said pivotally or shiftably movable functional component, wherein said bottom plate and/or said top bar forms an inseparable single-piece component with at least one of said functional members, and form a single-piece assembly with at least one elastically deformable connecting element, and where said plate and bar are movable between a proximate position where they are separated by a minimum distance and a distal position where they are separated by a maximum distance, characterized in that said plate 2 includes snap fit means arranged to cooperate, in the proximate position only, with a complementary snap fit means comprised in said bar for holding said plate and bar in the proximate position. According to a feature of the invention, said cassette is an escapement mechanism cassette, and said functional components are formed by at least one regulator member pivoted between said plate and said bar on pivots, at least one escape wheel, a first elastic return means, and at least one means of intermittently locking said at least one escape wheel cooperating with said at least one regulator member which is moved in a reciprocating motion under the action of the first elastic return means.

The invention also concerns a mechanical timepiece movement including at least one cassette of this type.

The advantage of making components in a single-piece, and in particular with the plate or the bars, is that the number of parts is reduced, and assembly problems are avoided. The invention benefits from the precision with which these monolithic components are made (typically, the parts are for example made of silicon and therefore enjoy micrometric precision).

The monolithic cassette has the main advantage of guaranteeing the distances between centres and of forming a ready-to-use mechanism, in particular an oscillator in a preferred application.

The invention incorporates, in particular, flexible guide members, which have the following advantages:

- guaranteed precision;
- very reduced or zero friction level;
- no hysteresis in the movements, due to the absence of friction or at least the extremely reduced level of friction;

no lubrication;

no play;

no wear.

The fabrication of these flexible guide members results in limitations, notably a limited travel, low return forces, and a limited load. However, these limitations are not prohibitive for a number of horological functions, in particular those which relate to regulation.

These limitations are amply compensated by the high precision of the distance between centres, the small number of components to be made and hence the reduced complexity and assembly time. A cassette according to the invention has a great industrial advantage: the mechanism cassette, particularly an oscillator, forms a component ready for assembly in a movement. Further, there is nothing to prevent an entire movement being devised in the form of a cassette of the invention.

BRIEF DESCRIPTION OF THE DRAWINGS

Other features and advantages of the invention will appear upon reading the following detailed description, with reference to the annexed drawings, in which:

FIG. 16 illustrates the adjustment of a pivot for hooking a balance spring by an elastic adjustment means including a comb, the clamping in position of the comb in an adjusted position, and a locking mechanism controlling the clamping means. FIG. 16A illustrates a similar example where the comb is held between two flexible strips and forms a bistable component. FIG. 17 illustrates a similar mechanism with a comb locking an index located at the end of a flexible strip, the comb being pressed onto said index by a clamping strip spring which is in turn locked by a locking finger.

DETAILED DESCRIPTION OF PREFERRED EMBODIMENTS

Figure 1:
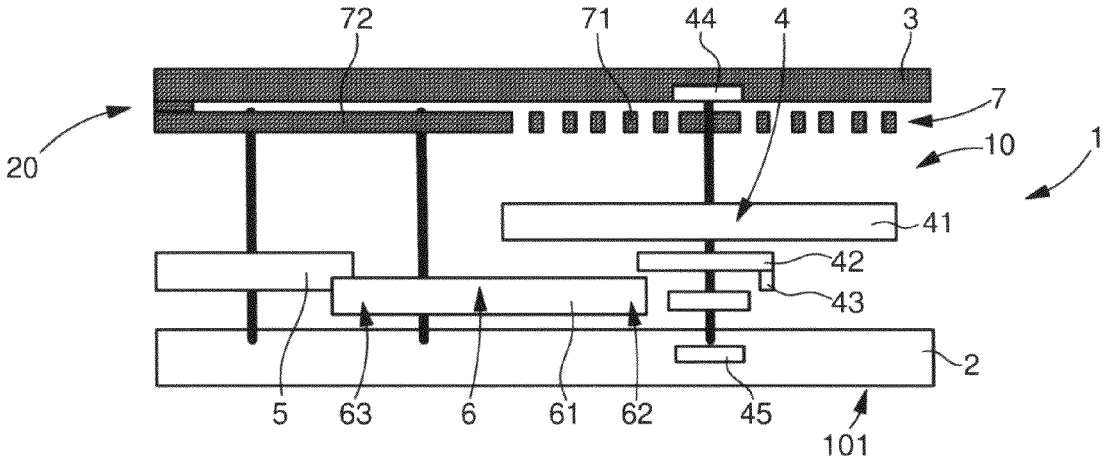
FIG. 1 shows a schematic side view of a cassette according to the invention, for the particular case of an escapement mechanism and including a balance spring made in a single-piece with a bar.
Figure 2:
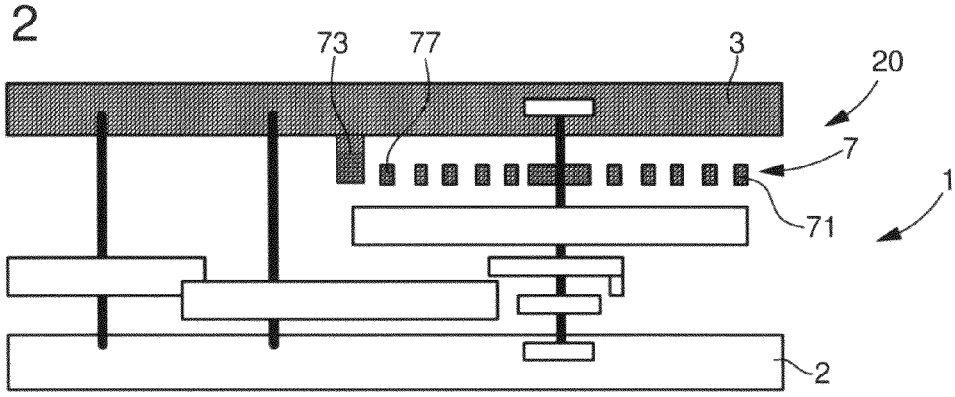
FIG. 2 shows, in a similar manner to FIG. 1, a similar variant.

The invention concerns the field of timepiece mechanisms, and more specifically movements integrating ready-to-use functional modules.

The invention concerns a timepiece mechanism cassette 1, including at least one bearing surface 101 for positioning the cassette in a movement 100, and at least one bottom plate 2 and one top bar 3, at least the plate 2 or bar 3 being rigid, i.e. including at least one area, carrying a bearing surface 101 of this type, which is sufficiently rigid to allow cassette 1 to be handled and operating precision to be maintained, in addition to the dimensional precision of the distance between centres of the functional components 10 comprised in said cassette 1, during the assembly of cassette 1, during the handling thereof, and after the integration thereof in movement 100.

Functional components 10 are arranged between or on plate 2 and bar 3. At least two of these functional components 10 are movable in relation to each other.

At least one pivotally or shiftably movable functional component 10 is pivoted or moved between plate 2 and bar 3.

According to the invention, the bottom plate 2 and/or top bar 3 forms an inseparable single-piece component 20 with at least one of functional members 10.

In a particular embodiment, at least one functional component 10 is pivotally movably mounted between said plate 2 and said bar 3 in which it is pivoted directly or via bearings.

In a particular embodiment, at least one functional component 10 which is pivoted between plate 2 and bar 3 forms an inseparable single-piece component 20 with bottom plate 2 and/or top bar 3.

In a particular embodiment, at least one functional component 10 is pivotally movably mounted between said plate 2 and said bar 3 in which it is pivoted directly or via bearings.

The following description will focus on single-piece embodiments, which are the most advantageous. This in no way prevents the attainment of a cassette of the invention with certain added components, which may be more advantageous in terms of cost in some particular cases.

Advantageously, this inseparable single-piece component 20 includes an integrated elastic return means for performing a function of energy distribution and/or regulation and/or return and/or damping and/or locking in an adjustment position.

Figure 16:
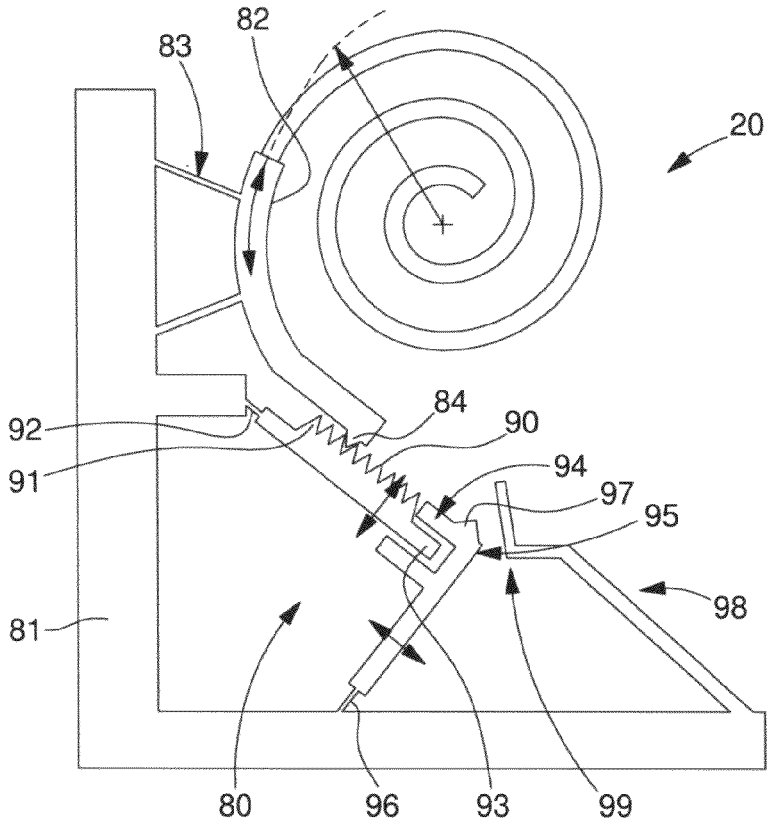
FIGS. 16, 16A and 17 show a plan view of a single-piece assembly including a means of adjusting the position of a component which is also integrated in said assembly, said adjustment means being lockable in position by a clamping means.
Figure 16A:
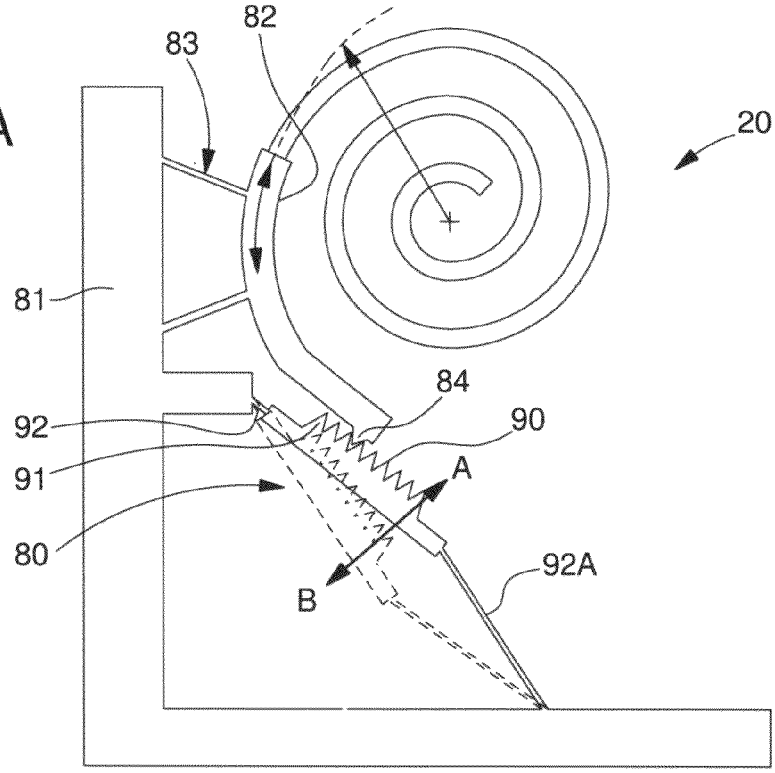

In a particular embodiment, the integrated elastic return means includes at least one flexible bistable or multi-stable element, as seen for example in FIG. 16A, which shows a bistable element working by buckling, and including a comb 91 between two substantially aligned resilient strips 92 and 92A, the assembly being capable of occupying two stable positions; a first activated position A where comb 91 cooperates with a finger 84 of a movable stud 82, and a second release position B where it is detached therefrom.

To allow this type of cassette 1 to be easily pre-adjusted, at least one of functional components 10 is position adjustable and is lockable in a pre-adjusted position by a locking means.

In a particular, non-limiting application, more particularly illustrated in the Figures, cassette 1 is an escapement mechanism cassette, and functional components 10 are formed by at least one regulator member 4, such as a balance, pivoted between plate 2 and bar 3 on pivots 45 and 44, at least one escape wheel 5, a first elastic return means 7, such as a balance spring, and at least an intermittent clamping means 6, such as a pallet lever, for intermittently clamping said at least one escape wheel 5, and cooperating with said at least one regulator member 4, which is moved in a reciprocal motion under the action of first elastic return means 7.

Pivots 44, 45 may be formed by conventional pivots or by flexible guide members.

In a particular embodiment, as seen in particular in FIGS. 1 to 4, the first elastic return means 7 forms an inseparable single-piece component 20 with top bar 3.

In a particular embodiment, the first elastic return means 7 includes a balance spring 71 whose outer end is fixed to a stud 73 in a single-piece with top bar 3.

Figure 3:
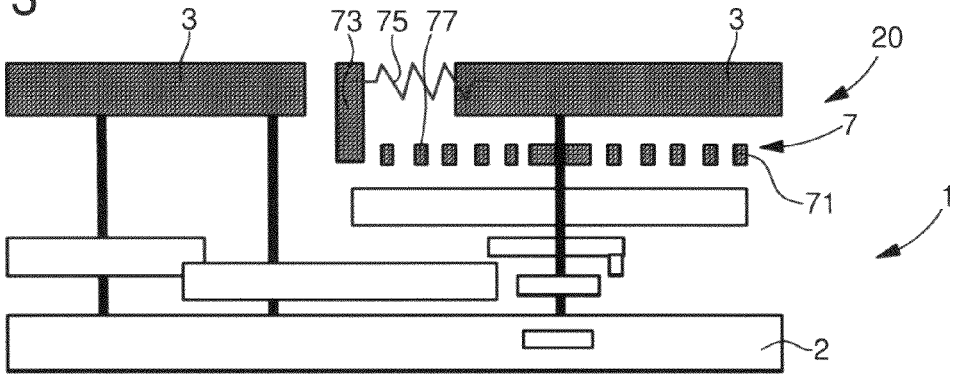
FIG. 3 shows, in a similar manner to FIG. 1, a variant wherein the balance spring is made in a single piece with a stud, which is in turn made in a single piece with the bar to which it is connected by an integrated elastic return means.
Figure 17:
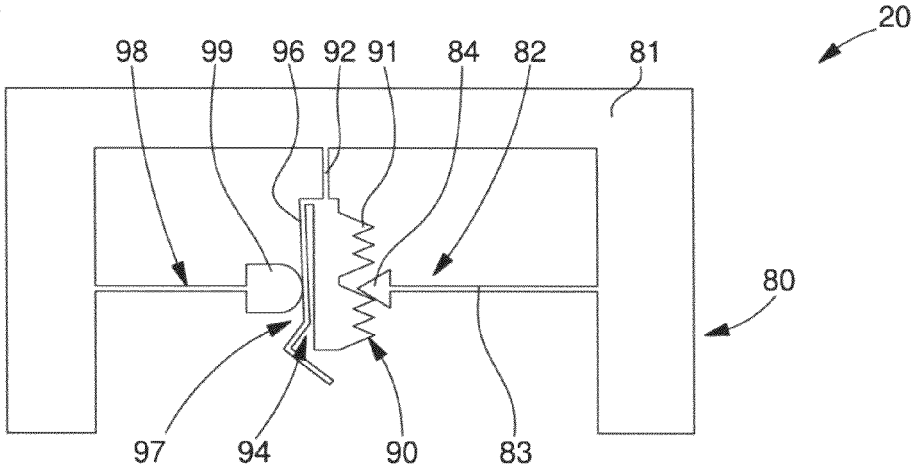

In the FIG. 3 variant, the first elastic return means 7 is thus formed by a balance spring 71 made in a single piece with stud 73 to which the balance spring is attached via its outer coil 77. This stud 73 is in turn made in a single piece with bar 3, to which it is connected by a second elastic return means 75 made in a single piece with stud 73 and bar 3. Preferably, the stud position adjustment, achieved by exploiting the elasticity of the second elastic return means, is maintained by a clamping means, not shown in FIG. 3, but an example of which is shown in FIGS. 16 and 17.

The adjustment of the active length of the outer coil of balance spring 71 may be achieved in various manners.

In a variant, the outer coil 77 of balance spring 71 is clamped by two pins 74A, 74B in a single-piece with top bar 3.

In another variant, at least one of pins 74 is secured to the top bar 3 by a second elastic return means 76, which is in a single piece with said at least one pin 74A or 74B and bar 3, and which tends to move said pin closer to the other pin 74B or 74A.

Figure 4:
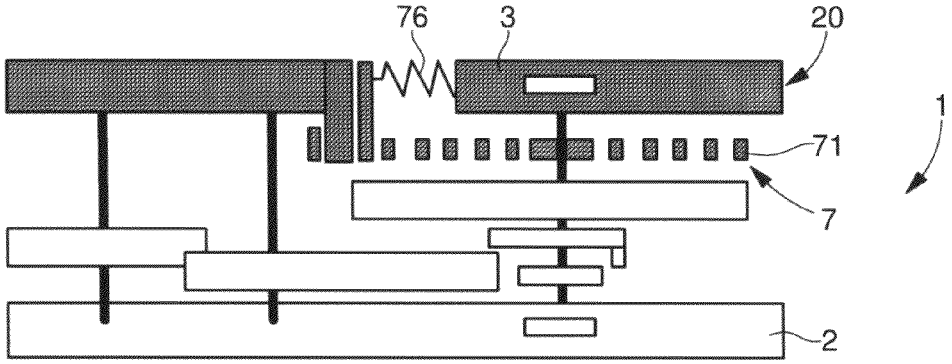
FIG. 4 shows, in a similar manner to FIG. 1, a variant wherein the balance spring is made in a single piece with the stud, which is in turn in a single piece with the bar, and wherein the outer end of the balance spring is clamped by pins in a single piece with the bar, and at least one of which is connected by an integrated elastic return means to the bar.

FIG. 4 therefore shows a variant of the FIG. 3 embodiment, wherein balance spring 71 is also made in a single piece with a stud 73, which is in turn made in a single piece with bar 3, and wherein the outer end of the balance spring is clamped, at a distance from stud 73, by pins 74A and 74B in a single piece with bar 3, together forming the equivalent of an index 74 for modifying the active length of balance spring 71.

Figure 5:
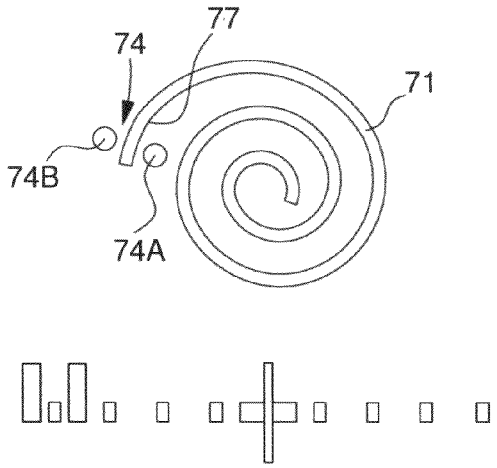
FIG. 5 shows a plan view and a side view of conventional pins with play.
Figure 6:
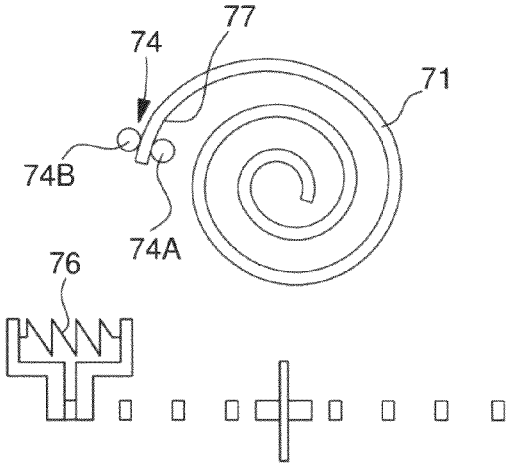
FIG. 6 shows a plan view and a side view of a pair of pins of this type clamping the balance spring under the effect of integrated elastic return means.

In an embodiment without any play, as seen in FIG. 6, at least one of these pins 74A and 74B is connected to bar 3 by an elastic return means 76, which is also integrated in bar 3. FIG. 5, however, illustrates an embodiment with very slight play, wherein the radial, independent adjustment of pins 74A and 74B adjusts the isochronism of the movement in the various positions.

This elastic return means 76 is formed, in particular, of one or more flexible elements, located either in the plane of balance spring 71, or in the plane of bar 3, or in any other plane. In an advantageous variant, balance spring 71 and/or pins 74A or 74B may be notched locally to allow for discrete, notch-by-notch adjustment.

In another variant, balance spring 71 is held in a flexible index 74 of this type with pins 74A and 74B. Index 74 is in a single piece with bar 3, although balance spring 71 is not necessarily in a single piece with stud 73 or with bar 3.

In a particular embodiment, the intermittent clamping means 6 forms an inseparable single-piece component 20 with bottom plate 2.

In a conventional application, intermittent clamping means 6 is a pallet lever 61 in a single-piece with plate 2 to which it is connected by a third elastic return means 65.

This pallet lever 61 has a top part 62 carrying pallet stones, horns and a dart. In a particular embodiment, the pallet lever is added and fixed to a bottom part 63 which is in the plane of plate 2 to which it is connected by a third elastic return means 65 which is also in the plane of plate 2.

In another variant, pallet lever 61 includes a top part 62 carrying pallet stones, horns and a dart in one or more parts 62A, 62B. This top part 62 is in a single-piece with a bottom part 63 and extends above it towards bar 3. Bottom part 63 is in the plane of a plate 2 to which it is connected by a third elastic return means 65 which is also in the plane of plate 2.

FIGS. 7 to 10 more particularly illustrate this embodiment of an intermittent clamping means 6 formed by a pallet lever 61 with a top part 62 carrying, at one end 62A, pallet stones cooperating with escape wheel 5, and at another end 62B, a dart and horns cooperating with a roller 42 and an impulse pin 43 of a balance 41.

Figure 7:
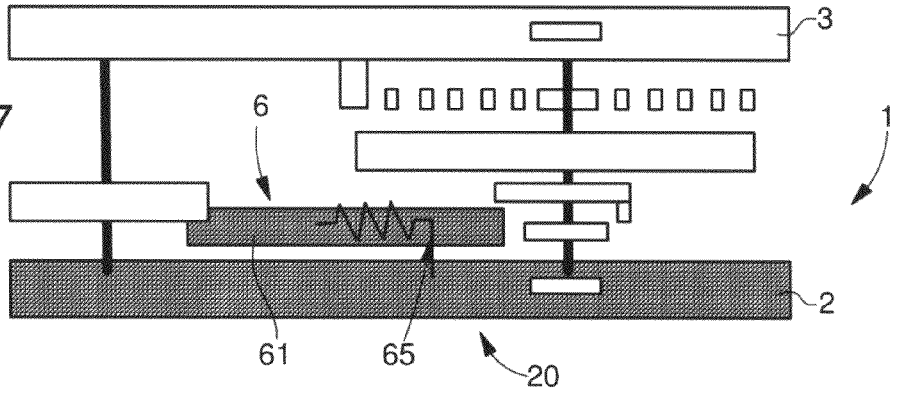
FIG. 7 shows, in a similar manner to FIG. 1, a variant wherein a pallet lever is made in a single piece with a plate, to which it is connected by an integrated elastic return means.

In the variant of FIG. 7, pallet lever 61 is made in a single-piece with plate 2 to which it is connected by an integrated elastic return means 65.

Figure 8:
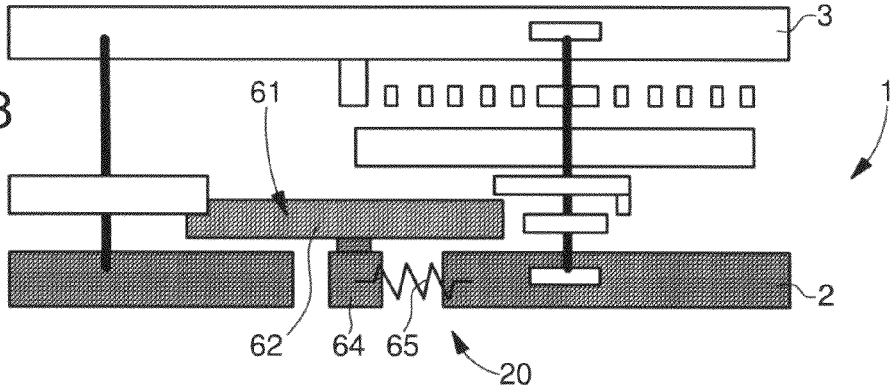
FIG. 8 shows, in a similar manner to FIG. 7, a variant wherein a pallet lever of this type includes a foot in the plane of the plate, in addition to said integrated elastic return means.

In the FIG. 8 variant, pallet lever 61 includes a foot 64 in the plane of plate 2, in addition to integrated elastic return means 65 which is also in the plane of plate 2.

Figure 9:
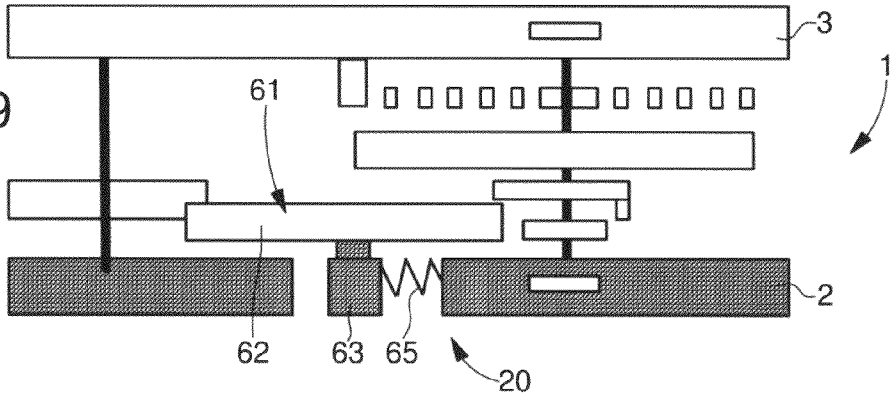
FIG. 9 shows, in a similar manner to FIG. 8, a variant wherein the actual pallet lever is secured to a foot of this type.

In the FIG. 9 variant, the top part 62 of pallet lever 61 is added to a foot 63 of this type and this top part 62 is not in a single-piece with said foot 63.

Figure 10:
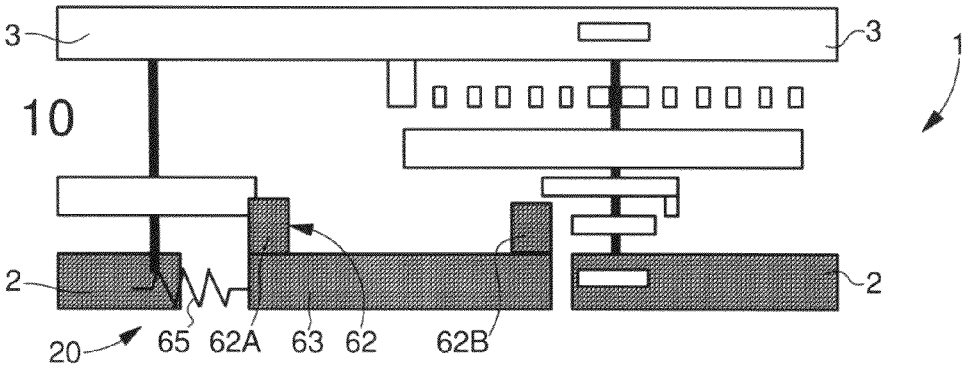
FIG. 10 shows, in a similar manner to FIG. 7, a variant wherein a pallet lever of this type is in the plane of the plate and includes protruding parts, such as the dart, horns and pallet stones, on at least one upper level.

In the FIG. 10 variant, the pallet lever is in the plane of the plate and includes protruding portions 62A and 62B such as pallet stones and respectively a dart and horns, on at least one upper level.

Advantageously, in these different variants, plate 2 incorporates pins or solid banking pins limiting the clearance of the pallet lever, which are in a single piece with said plate 2.

In general, the incorporation of limiting elements, regardless of whether they are in plate 2, bar 3 or another inseparable single-piece component 20, is an advantage of the invention.

The design of cassettes 1 according to the invention including inseparable single-piece components 20 also optimises the pivoting of the various mobile components and, as required, ensures the parallelism thereof, or conversely permits at least one end of a mobile component arbour to be moved to perform a micrometric setting adjustment.

The action on the pivot points permits, in particular, the distance of centres between the mobile components to be adjusted to adjust the penetration of the toothings and/or lifting pieces. The distance of centres adjustment may be carried out in a monolithic manner with the plate or the bar. This principle of adjusting the distance between centres is valid for all the distances between centres in a movement.

Figure 11:
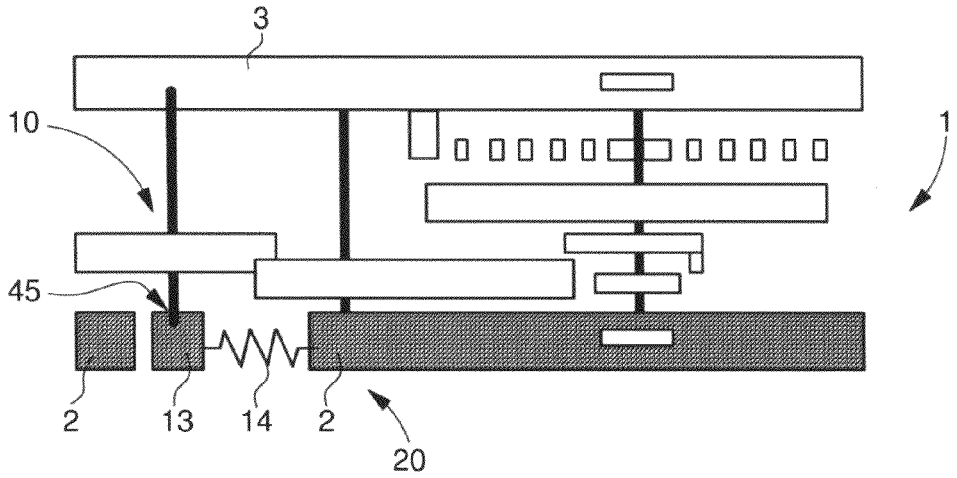
FIG. 11 shows, in a similar manner to FIG. 1, a variant wherein at least one of the mobile components of the assembly, particularly an escape wheel, is pivoted at at least one of the ends thereof in a bearing holder connected to the plate by an integrated elastic return means, and is lockable in position.

In this FIG. 11 variant, at least one pivotally movable functional component 10 is pivoted, at at least one end thereof, in a top pivot 44 or a bottom pivot 45 housed in a bearing holder 13. This bearing holder 13 is connected to plate 2 and/or to bar 3 by a fourth integrated elastic return means 14, which is preferably in a single piece with plate 2 and/or bar 3, and with the respective bearing holder 13.

Naturally, it is also possible to envisage a variant wherein this component is pivoted at both ends in suspended bearing carriers.

The fourth elastic return means 14 allows for a range of adjustment, the return means is preferably associated with a post-adjustment position locking means, an example of which is given in the present description in the particular case of FIG. 16 or 17. Advantageously, this position locking means is also made in a single piece with plate 2 and/or bar 3 respectively and with the respective bearing holder 13.

Figure 12:
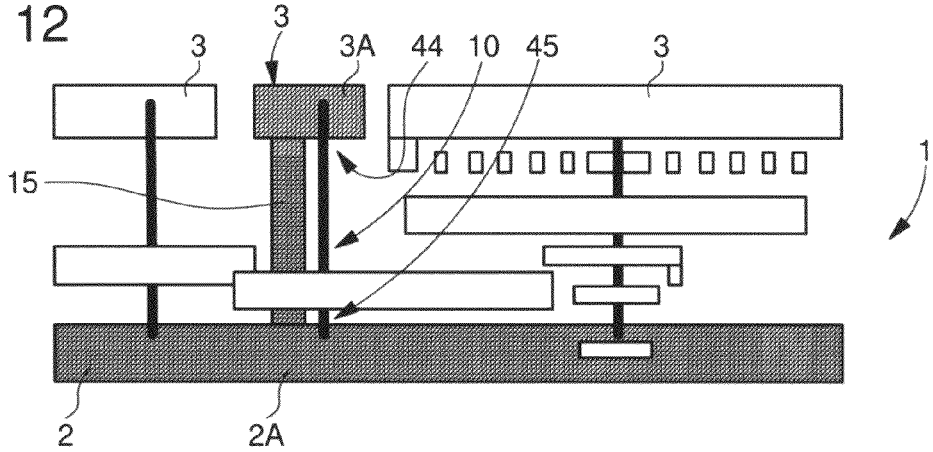
FIG. 12 shows, in a similar manner to FIG. 1, a variant wherein at least one of the mobile components of the assembly is pivoted at at least one of the ends thereof in the plate, and at the other end thereof to a bearing holder substantially on the level of the bar and connected to the plate by a cross-piece.
Figure 13:
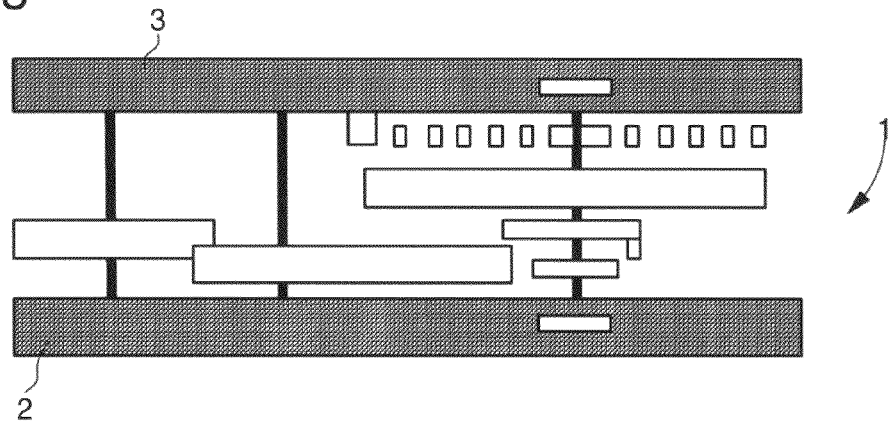
FIG. 13 shows, in a similar manner to FIG. 1, a cassette with a plate and a bar each in a single-piece.

In a particular embodiment visible in FIG. 12, at least one pivotally movable functional component 10 is pivoted, at a top end in a top pivot 44 housed in a top element 3A of bar 3, and at a bottom end in a bottom pivot 45 housed inside a bottom element 2A of plate 2. Top element 3A of bar 3 and bottom element 2A of plate 2 form a single-piece assembly with a cross-piece 15 joining them to each other.

In a variant, the top element 3A of bar 3 forms the whole of bar 3, and/or bottom element 2A of plate 2 forms the whole of plate 2.

Figure 14:
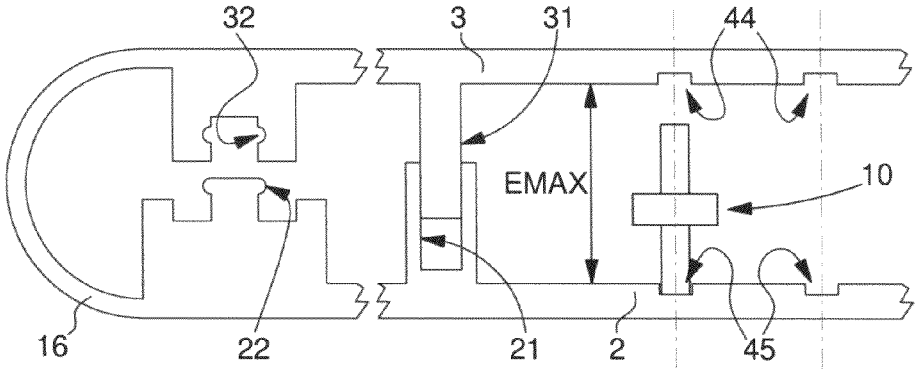
FIGS. 14 and 15 show, in a similar manner to FIG. 1, a cassette with a plate and a bar forming a single-piece assembly with each other, shown in two positions, a distal position in FIG. 13 and a proximate position in FIG. 14, said plate and said bar including guide elements for a movement parallel to each other, and a means for snapping them into the proximate position.
Figure 15:
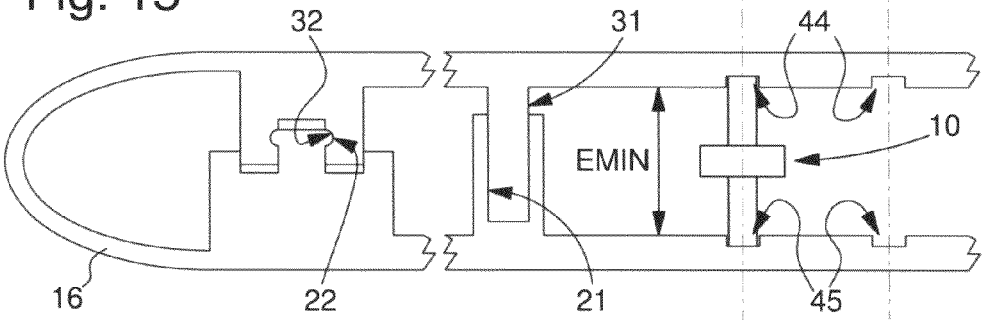

In a particular embodiment visible in FIGS. 14 and 15, plate 2 and bar 3 form a single-piece assembly with at least one elastically deformable connecting element 16, and plate 2 and bar 3 are movable between a proximate position (FIG. 15) where they are separated by a minimum distance EMIN and a distal position (FIG. 14) where they are separated by a maximum distance EMAX.

To maintain the operating position corresponding to minimum distance EMIN, plate 2 includes snap fit means 22 arranged to cooperate, in the proximate position only, with a complementary snap fit means 32 comprised in bar 3 for holding plate 2 and bar 3 in the proximate position.

Preferably, plate 2 then includes a guide means 21 cooperating, in any position, with a complementary guide means 31 comprised in bar 3, for a parallel relative movement of plate 2 with respect to bar 3.

In a particular embodiment, cassette 1 includes at least one pivotally movable functional component 10 between a bottom pivot 45 integral with plate 2 and a top pivot 44 integral with bar 3, between which the pivotally movable functional component 10 is freely inserted in the distal position, and between which it is mounted, axially confined and free to pivot in the proximate position.

For a particularly advantageous application to a mechanism which is adjustable and lockable, notably in a reversible manner, but which can also be locked (notably irreversibly) after an initial adjustment, at least one inseparable single-piece component 20 includes a position adjustable mechanism 80. FIGS. 16 and 16A illustrate a non-limiting application to the angular positioning of a stud 82 for holding a balance spring.

In a particular manner this inseparable single-piece component 20 includes a position adjustable mechanism 80 including a rigid structure 81.

This position adjustable mechanism 80 includes a rigid structure 81 which carries, via at least one elastic strip 83, a position adjustable component 82. This rigid structure 81 may be plate 2, bar 3 or any of the inseparable single-piece components 20 comprised in cassette 1.

In the case of FIG. 16, this position adjustable component 82 includes an indexing means 84, which is arranged to cooperate with a complementary indexing means 91, here formed by a comb or a toothed sector, comprised in an adjustment mechanism 90. This complementary indexing means 91 is detachably mounted to indexing means 84. It can also be locked in a cooperating position by a clamping mechanism 94.

This clamping mechanism 94 is resiliently secured to structure 81 by at least one flexible element 96 and is preferably in turn subject to the action of a locking mechanism which allows mechanism 94 to occupy either a detached position in which adjustment mechanism 90 is free, or an engaged position in which clamping mechanism 94 hinders adjustment mechanism 90. This locking mechanism is resiliently secured to the structure 81, and allows said clamping mechanism 94 to occupy either a detached position in which this adjustment mechanism 90 is free, or an engaged position in which clamping mechanism 94 hinders adjustment mechanism 90. This locking mechanism includes at least one flexible element 98 forming a jumper and resiliently secured to structure 81, said at least one flexible element 98 here includes a beak 99 which cooperates with a beak 97 of clamp 94 to hold the clamp away during the position adjustment, or with a complementary stop surface 95 of clamp 94 as security for the clamp when the position adjustment is carried out. The latter is in the form of a fork so as to limit the travel of an arm 93 comprised in comb 91.

FIG. 16A illustrates a similar example where comb 91 is held between two substantially aligned flexible strips 92 and 92A and form a bistable component, operating by buckling, the assembly can occupy two stable positions: a first activated position A where comb 91 cooperates with a finger 84 of a moveable stud 82 and a second release position B where the comb is detached from the finger.

FIG. 17 illustrates a similar mechanism with a comb 91 locking an index 84 located at the end of a flexible strip 83, comb 91 being pressed onto index 84 by a clamping strip-spring 96 belonging to clamp 94, which is in turn locked by a locking finger 99 mounted on at least one flexible strip 98, said finger 99 cooperating with a stop surface 97 of strip 96.

As seen above, this combined adjustment, clamping and locking mechanism, illustrated here for a particular application of adjusting a stud on a travel concentric to the arbour of a balance spring, is applicable to a wide range of applications: positioning a bearing, a stop member, or other element.

Figure 18:
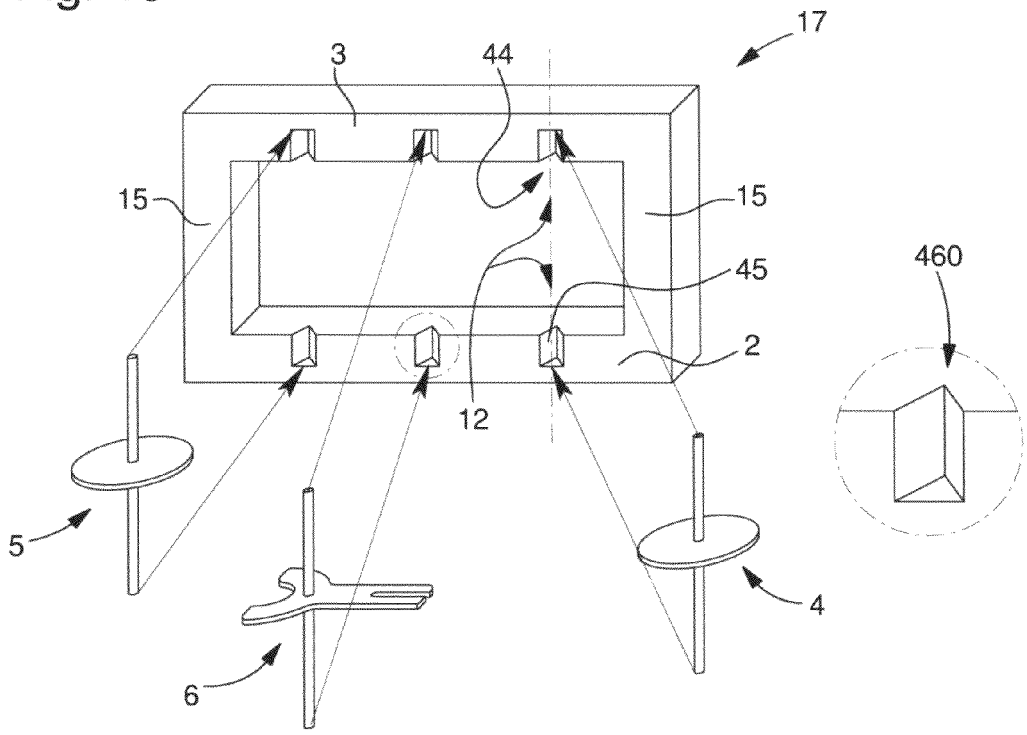
FIG. 18 shows a perspective view of a deformation resistant single-piece frame including housings aligned in pairs forming pivots for receiving the ends of mobile component arbours.

In a particular embodiment, visible in FIG. 18, cassette 1 includes an inseparable single-piece structure 11 including pivot points 12 aligned in pairs for receiving pivots of components of the mechanism incorporated in cassette 1, particularly an escapement mechanism. This structure 11 includes at least one frame 17.

Figure 19:
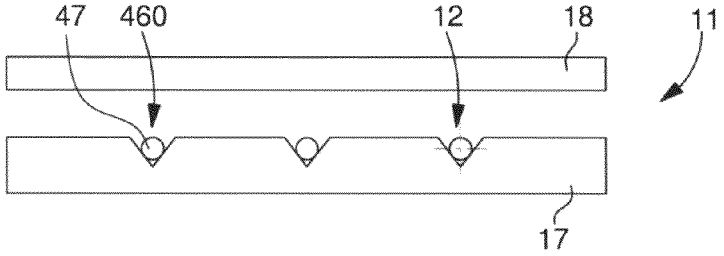
FIGS. 19 and 20 illustrate a top view of the cooperation of a cover with this frame, respectively in open and closed positions, for immobilising the arbour ends.
Figure 20:
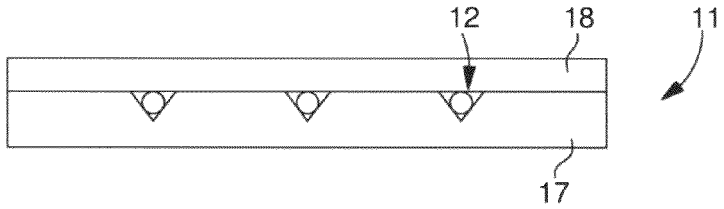

In the non-limiting variant of FIGS. 18, 19 and 20, plate 2 and bar 3 form, with at least one cross-piece 15, an inseparable single-piece frame 17 including housings 460 which are aligned in pairs each time for receiving an arbour 47 of a pivotally movable functional component 10 comprised in cassette 1. Cassette 1 further includes at least one cover 18, which is arranged to cooperate with frame 17 in order, in the closure position of cover 18 on frame 17, to enclose with minimum play each said arbour 47 of each pivotally movable functional component 10 comprised in cassette 1. Advantageously, cover 18 is irreversibly fixed to frame 17 to form an inseparable single-piece structure 11.

This architecture of FIG. 18, incorporating the plate and bar, is a particular example, frame 17 may also be independent of the plate and of the bar, and be fixed to one or the other, or to both at the same time.

Figure 20A:
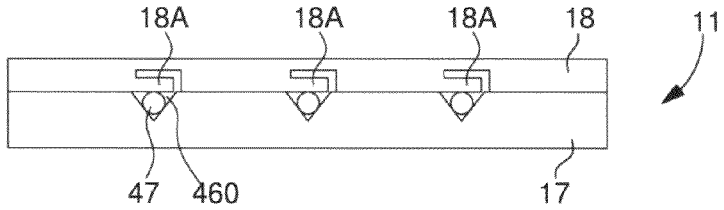
FIG. 20A illustrates an advantageous variant of the cover with flexible play take-up strips.

Advantageously, cassette 1 includes a flexible play take-up means for confining without play each said arbour 47 of each said pivotally movable functional component 10 comprised in cassette 1. FIG. 20A illustrates an example embodiment of cover 18 with elastic lips 18A performing the play take-up.

In an advantageous embodiment, cassette 1 is made of silicon. The pivot points of housings 460 are defined, for example, by anisotropic (KOH) etches in a silicon substrate. A version with an assembly of jewels is also possible. The great advantage is the very precise positioning of the pivot points (distance from centres, verticality). It is noted that placing cover 18 in position does not disrupt the positioning of the various arbours.

Figure 21:
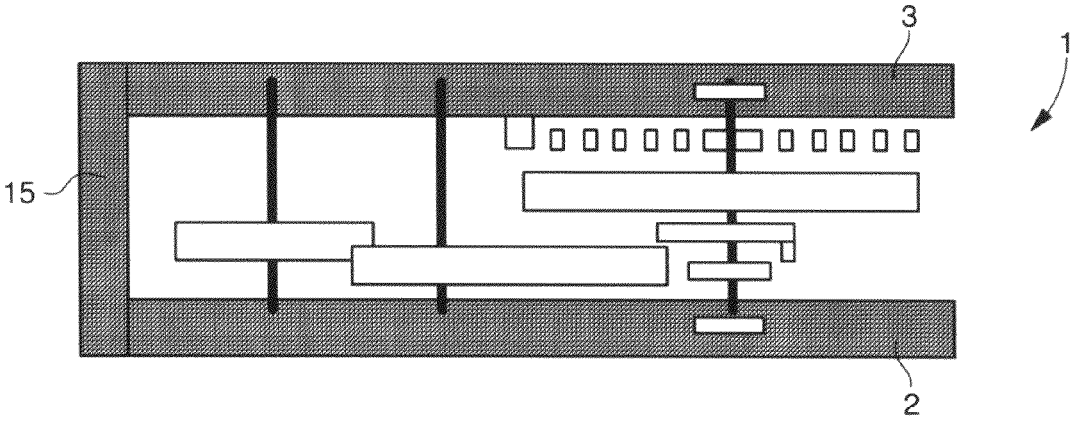
FIGS. 21, 22, 23 show, in a similar manner to FIG. 1, cassettes wherein the plate and the bar together form a single-piece component.
Figure 22:
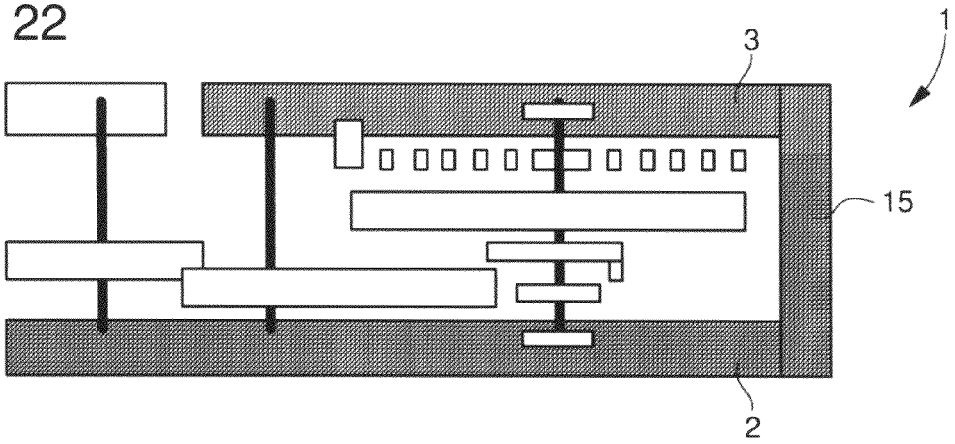
Figure 23:
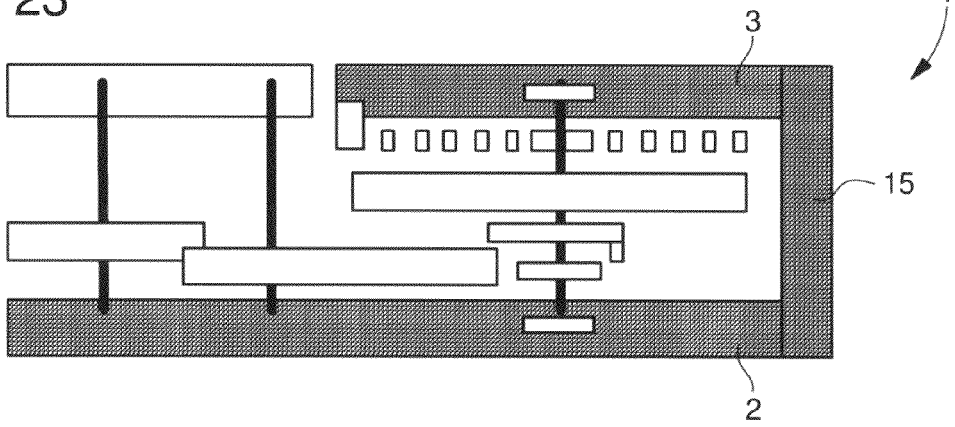

FIGS. 21 to 23 illustrate cassettes, which may be made of silicon or multi-level Liga, wherein plate 2 and bar 3 together form a single piece component with at least one cross-piece 15. Depending upon the configuration thereof, this assembly incorporates all or part of the guide bearings for the mobile component arbours:

- the two pivot points of the pallet lever and all of the bottom bearings of the other mobile components;
- the two pivot points of the balance, and of the pallet lever, and all of the bottom bearings of the other mobile components;
- the two pivot points of the balance and all of the bottom bearings of the other mobile components.

In another particular embodiment of the invention, bottom plate 2 and/or top bar 3 and/or frame 17 forms an inseparable single-piece component 20 with at least one shockproof bearing for receiving a pivot of a component of the mechanism incorporated in cassette 1, particularly an escapement mechanism.

Figure 24:
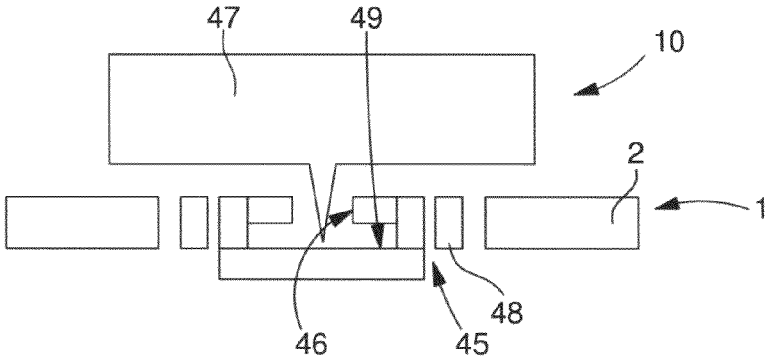
FIG. 24 shows a cross-section through the arbour of a pivot with a shockproof bearing in a single-piece with a plate or a bar.

In the particular embodiment of FIG. 24, at least one functional component 10 comprised in cassette 1 is pivotally movable between a bottom pivot 45 integral with plate 2 and a top pivot 44 integral with bar 3, and at least one bottom pivot 45 or top pivot 44 is made in a single-piece with plate 2 or with bar 3 and includes a shoulder of revolution 46 for radially holding an arbour 47 of pivotally movable functional component 10, and a frontal shoulder 49 for axially limiting the end of arbour 47. Shoulder of revolution 46 and frontal shoulder 49 are preferably both carried by a resilient shock absorber 48 which is also in a single-piece with said shoulders. In a variant, it is at least the elastic shock absorber 48 which is in a single-piece with plate 2, whereas shoulder of revolution 46 and frontal shoulder 49 are each either in a single-piece with plate 2 or added thereto (jewels or similar).

The shock absorbers may thus be partially or totally made inside the plate: the shock absorber spring may be made jointly with the plate. One of the two (or both) jewels may be made jointly with the plate. The pivoting then occurs directly in the silicon. The pivot points may be made straight in the silicon with DLC or other surface coatings. There are thus no longer any jewels and the points of rotation are very precisely positioned.

In a particular embodiment, inseparable single-piece component 20 includes severable elements intended to facilitate the assembly of the component in a larger assembly, the severable elements then only need to be broken off to give one or more degrees of freedom to some of its constituent parts.

In a particular embodiment, at least one of movable functional components 10 comprised in cassette 1 is integral with at least one linear flexible guide member which is in a single piece with plate 2 and/or bar 3.

In another particular embodiment, all the movable functional components 10 comprised in cassette 1 are each integral with at least one flexible linear guide member which is in a single piece with plate 2 and/or bar 3.

In an advantageous embodiment of cassette 1 according to the invention, the inseparable single-piece component 20 is made of micromachinable material, or silicon, or silicon oxide, and the integrated elastic returns means of the inseparable single-piece component is pre-stressed in a silicon oxide state. Other materials in MEMS or "LIGA" technology may be employed. Quartz, DLC, at least partially amorphous materials or metallic glasses, may be used for these applications, although the list is not limiting. Diamond, ruby or corundum may also be used.

Particular structuring of plate 2 and/or bar 3 and/or the inseparable single-piece components 20 may compensate the effects of expansion of these structural elements or components of the mechanism of cassette 1. It is, for example, possible to make the plate in silicon, and then oxidise it, for the sake of consistency.

What is claimed is:

1. A timepiece mechanism cassette, comprising:

at least one bearing surface for positioning the cassette in a movement;

at least one bottom plate and one top bar, at least said plate or said bar being rigid;

functional components positioned between or on said plate or said bar, at least two of the functional components being movable relative to each other, and at least one of the functional components is a pivotally movable functional component positioned between said plate and said bar, wherein at least one of said bottom plate and said top bar forms an inseparable single-piece component with at least one of said functional components, and forms a single-piece assembly with at least one elastically deformable connecting element, and wherein said plate and bar are movable between a proximate position where they are separated by a minimum distance and a distal position where they are separated by a maximum distance, wherein said plate includes snap fit means forming a single piece with said plate and arranged to cooperate, in the proximate position only, with a complementary snap fit means comprised in said bar and forming a single piece with said bar for holding said plate and bar in the proximate position, wherein said plate further includes a guide means forming a single piece with said plate and cooperating, in any position, with a complementary guide means further comprised in said bar and forming a single piece with said bar, for a parallel relative movement of said plate with respect to said bar, and wherein said pivotally movable functional component is positioned between a bottom pivot integral with said plate and a top pivot integral with said bar, said pivotally movable functional component is freely inserted between the bottom pivot and the top pivot in the distal position, and said pivotally movable functional component is mounted, axially confined and free to pivot between the bottom pivot and the top pivot in the proximate position.

2. The cassette according to claim 1, wherein said inseparable single-piece component includes a position adjustable mechanism including a rigid structure which carries, via at least one elastic strip, a position adjustable component which includes an indexing means arranged to cooperate with a complementary indexing means comprised in an adjustment mechanism, said complementary indexing means being detachably mounted to said indexing means and lockable in a cooperating position by a clamping mechanism resiliently secured to said structure, and where said clamping mechanism is subject to the action of a locking mechanism resiliently secured to said structure, said locking mechanism which allows said clamping mechanism to occupy either a detached position in which said adjustment mechanism is free, or an engaged position in which clamping mechanism hinders adjustment mechanism.

3. The cassette according to claim 1, wherein the cassette is an escapement mechanism cassette, and said functional components are formed by at least one regulator member pivoted between said plate and said bar on pivots, at least one escape wheel, a first elastic return means, and at least one means of intermittently locking said at least one escape wheel cooperating with said at least one regulator member which is moved in a reciprocating motion under the action of the first elastic return means.

4. The cassette according to claim 3, wherein said first elastic return means forms said inseparable single-piece component with said top bar.

5. The cassette according to claim 4, wherein said first return means includes a balance spring whose outer end is fixed to a balance spring stud in a single piece with said top bar.

6. The cassette according to claim 5, wherein said stud is fixed to said top bar by a second elastic return means in a single piece with said stud and said bar.

7. The cassette according to claim 5, wherein said outer end of said balance spring is clamped by two pins in a single-piece with said top bar.

8. The cassette according to claim 7, wherein at least one of said pins is secured to said top bar by a second elastic return means which is in a single piece with said at least one pin and said bar, and which tends to move said pin closer to the other said pin.

9. The cassette according to claim 3, wherein said intermittent locking means forms said inseparable single-piece component with said bottom plate.

10. The cassette according to claim 9, wherein said intermittent locking means is a pallet lever in a single-piece with said plate to which said lever is connected by a third elastic return means.

11. The cassette according to claim 10, wherein said pallet lever includes a top part carrying pallet stones, horns and a dart, and which is added and secured to a bottom part, which is in the plane of said plate to which said pallet lever is connected by the third elastic return means which is also in the plane of said plate.

12. The cassette according to claim 10, wherein said pallet lever includes a top part carrying pallet stones, horns and a dart in one of more parts, and which is in a single piece with a bottom part and extends thereabove towards said bar, said bottom part is in the plane of said plate and is connected thereto by the third elastic return means which is also in the plane of said plate.

13. The cassette according to claim 3, wherein said cassette includes an inseparable single-piece frame including pivot points aligned in pairs for receiving pivots of components of said escapement mechanism.

14. The cassette according to claim 3, wherein said bottom plate and/or said top bar forms said inseparable single-piece component with at least one shockproof bearing for receiving a pivot of a component of said escapement mechanism.

15. The cassette according to claim 1, wherein said pivotally movable functional component is pivoted, at least at one end thereof, in the top pivot or the bottom pivot housed in a bearing holder connected to said plate and/or to said bar by a fourth elastic return means.

16. A mechanical timepiece movement including at least one cassette according to claim 1.

17. The cassette according to claim 1, wherein said at least one elastically deformable connecting element is configured to deform such that the plate and the bar remain parallel between the proximate position and the distal position.

* * * * *